US006612882B2

(12) United States Patent
Shidara et al.

(10) Patent No.: US 6,612,882 B2
(45) Date of Patent: Sep. 2, 2003

(54) IDLING SPEED CONTROL SYSTEM FOR OUTBOARD MOTOR

(75) Inventors: Sadafumi Shidara, Wako (JP); Nobuhiro Takahashi, Takanezawa-machi (JP)

(73) Assignees: Honda Giken Kogyo Kabushiki Kaisha, Tokyo (JP); Keihin Corporation, Tokyo (JP)

( * ) Notice: Subject to any disclaimer, the term of this patent is extended or adjusted under 35 U.S.C. 154(b) by 0 days.

(21) Appl. No.: 10/028,314

(22) Filed: Dec. 28, 2001

(65) Prior Publication Data

US 2002/0086593 A1 Jul. 4, 2002

(30) Foreign Application Priority Data

Dec. 28, 2000 (JP) ..... 2000-400349

(51) Int. Cl.[7] ..... B63H 23/00
(52) U.S. Cl. ..... 440/1; 440/87; 123/339.1
(58) Field of Search ..... 440/1, 75, 86, 440/87; 123/339.1, 339.11, 339.12, 339.14, 339.21, 339.22, 339.26, 336

(56) References Cited

U.S. PATENT DOCUMENTS 4,359,983 A * 11/1982 Carlson et al. ..... 123/339.26
4,787,351 A * 11/1988 Sakamoto et al. ..... 123/339.22
5,110,312 A * 5/1992 Higby ..... 440/75
5,146,888 A * 9/1992 Sawamoto ..... 123/336
5,203,300 A * 4/1993 Orzel ..... 123/339.12
5,265,571 A * 11/1993 Sodeno ..... 123/339.17
5,364,322 A * 11/1994 Fukui ..... 477/108
5,630,394 A * 5/1997 Grizzle et al. ..... 123/339.19
5,685,270 A * 11/1997 Sekiguchi et al. ..... 123/339.21
5,701,867 A * 12/1997 Mizutani et al. ..... 123/339.16
5,765,528 A * 6/1998 Kamimaru ..... 123/339.14
5,894,828 A * 4/1999 Sivashankar et al. .. 123/339.11
5,910,191 A * 6/1999 Okamoto ..... 440/86
5,921,828 A * 7/1999 Ogino ..... 192/48.7
5,975,048 A * 11/1999 Sivashankar et al. ..... 123/295
6,035,652 A * 3/2000 Hashimoto ..... 123/339.17
6,077,136 A * 6/2000 Arai et al. ..... 440/86
6,098,591 A * 8/2000 Iwata ..... 123/339.11
6,109,986 A * 8/2000 Gaynor et al. ..... 123/336
6,123,591 A * 9/2000 Onoue ..... 192/48.91
6,375,525 B1 * 4/2002 Kanno ..... 123/339.19
6,415,766 B1 * 7/2002 Kanno et al. ..... 123/339.19

* cited by examiner

*Primary Examiner*—S. Joseph Morano
*Assistant Examiner*—Lars A. Olson
(74) *Attorney, Agent, or Firm*—Armstrong, Westerman & Hattori, LLP

(57) ABSTRACT

An idling speed control system for an outboard motor mounted on a boat and equipped with an internal combustion engine, whose output is connected to a propeller through a clutch, having secondary air supplier that supplies secondary air. In the system, a difference of preceding and present current command values each indicative of a desired secondary air supply amount is comparing with a predetermined value when the clutch is changed, and the current command value is increased or decreased by a predetermined correction amount when the difference is greater than the predetermined value. With this, it can surely improve the control stability and suppress the overshooting or undershooting of engine speed due to the load change when the clutch is changed, thereby enabling to eliminate or reducing the shock to be felt by the operator and improving the feeling of the operator.

22 Claims, 17 Drawing Sheets

IDLING SPEED CONTROL SYSTEM FOR OUTBOARD MOTOR

BACKGROUND OF THE INVENTION

1. Field of the Invention

This invention relates to an idling speed control system for an outboard motor, particularly to an idling speed control system for an outboard motor for small boats 2. Description of the Related Art Small motor-driven boats are generally equipped with a propulsion unit including an internal combustion engine, propeller shaft and propeller integrated into what is called an outboard motor or engine. The outboard motor is mounted on the outside of the boat and the output of the engine is transmitted to the propeller through a clutch and the propeller shaft. The boat can be propelled forward or backward by moving the clutch from Neutral to Forward or Reverse position.

The idling speed of this type of the engine is controlled by use of a secondary air supplier that supplies secondary air through a passage that is connected to the air intake pipe downstream of the throttle valve. The passage is equipped with a secondary air control valve and the desired idling speed is obtained by regulating the opening of the secondary air control valve.

The amount of secondary air required to achieve the desired idling speed varies with aged deterioration of the engine. It also differs with clutch position. This is because the idling speed differs between that when the clutch is in Neutral and that when it is in Forward or Reverse and the outboard engine is running forward or backward at very low speed, i.e., during trolling.

To give a specific example, say that the idling speed is 750 rpm when the clutch is in Neutral. When the clutch is then shifted into Forward or Reverse for low-speed trolling, since the hull acts to load and a quite low speed is required, the engine speed to fall to the trolling speed (herein defined as the idling speed during trolling) of around 650 rpm. The required amount of secondary air changes as a result.

With this, when the engine speed changes form the trolling speed to the idling speed and vice versa, as illustrated in FIG. 17, the engine speed may sometimes rise or drop sharply. The overshooting or undershooting of the engine speed from a desired speed due to the clutch change produce shock and hence, degrades feeling of the operator.

Further, if the operator of the outboard motor should replace the propeller, which is not uncommon, the resulting load change will change the engine speed and, accordingly, change the amount of secondary air required to achieve the desired idling speed.

As a result, when the manipulated value in the idling speed control is fixed to a value such that a desired idling speed is achieved, the stability of control is not satisfactory against the load change.

A possible technique to overcome the problem will be to determine the amount of secondary air required to achieve the desired idling speed through a learning control. However, the learning control is generally effective in steady state engine operation, but is less effective in the transient engine operation in which the clutch change results in switching of the idling speed to the trolling speed and vice versa. Thus, even if the learning control is introduced, this can not improve the control stability and can not surely suppress the overshooting or undershooting of engine speed due to the load change.

SUMMARY OF THE INVENTION

An object of the present invention is therefore to solve the problem by providing an idling speed control system for an outboard motor that is equipped with an internal combustion engine which supplies secondary air in such amount as to reduce difference between a desired idling speed determined in response to the clutch position and a detected engine speed, which can surely improve the control stability and suppress the overshooting or undershooting of engine speed due to the load change when the clutch is changed, thereby enabling to eliminate or reducing the shock to be felt by the operator during the clutch change and improving the feeling of the operator.

For realizing this object, there is provided a system for controlling an idling speed for an outboard motor mounted on a boat and equipped with an internal combustion engine whose output is connected to a propeller through a clutch such that the boat is propelled forward or reverse when the clutch is changed to a neutral position to a forward position or a reverse position, comprising: secondary air supplier that supplies secondary air trough a passage that is connected to an air intake pipe downstream of a throttle valve and that is equipped with a secondary air control valve such that amount of secondary air is supplied to the air intake pipe in response to an opening of the secondary air control valve; clutch position detecting means for detecting a position of the clutch; engine operating condition detecting means for detecting parameters indicative of operating conditions of the engine including at least an engine speed; desired value determining means for determining a desired idling speed based on the detected position of the clutch and for determining a desired secondary air supply amount such that a difference between the determined desired idling speed and the detected engine speed decreases; and valve controlling means for controlling the opening of the valve to a value that effects the desired secondary air supply amount; wherein the desired value determining means including: comparing means for calculating a change of the desired secondary air supply amount and for comparing the change with a predetermined value when it is determined based on the detected position of the clutch that the clutch is changed; change direction determining means for determining whether the change is in an increasing direction or in a decreasing direction; and correcting means for correcting the desired secondary air supply amount by a predetermined correction amount in the determined direction, when the change is greater than the predetermined value.

DETAILED DESCRIPTION OF THE PREFERRED EMBODIMENT

An idling speed control system for an outboard motor according to an embodiment of the present invention will now be explained with reference to the attached drawings.

Figure 1:
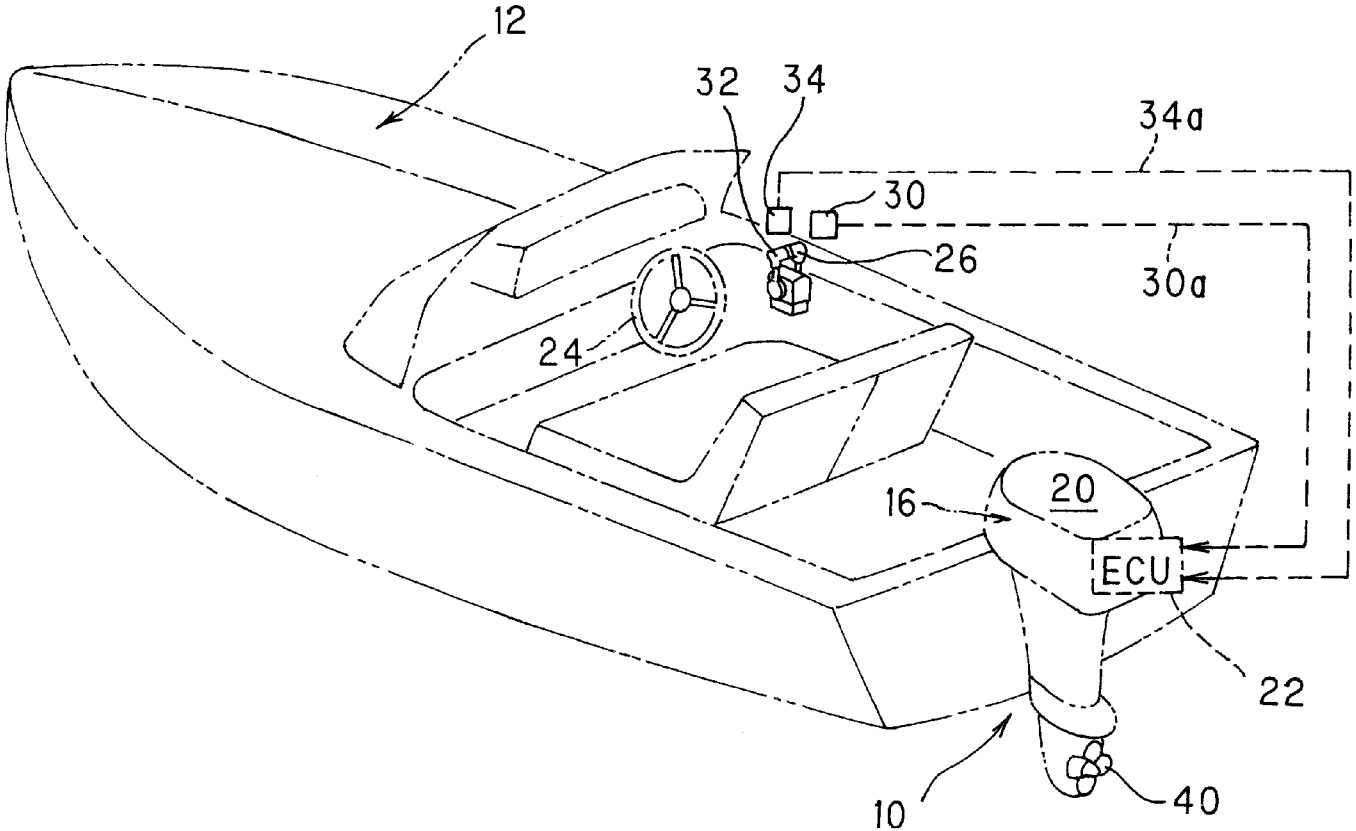
FIG. 1 is a schematic view showing the overall configuration of an idling speed control system for an outboard motor equipped with an internal combustion engine according to an embodiment of the present invention.
Figure 2:
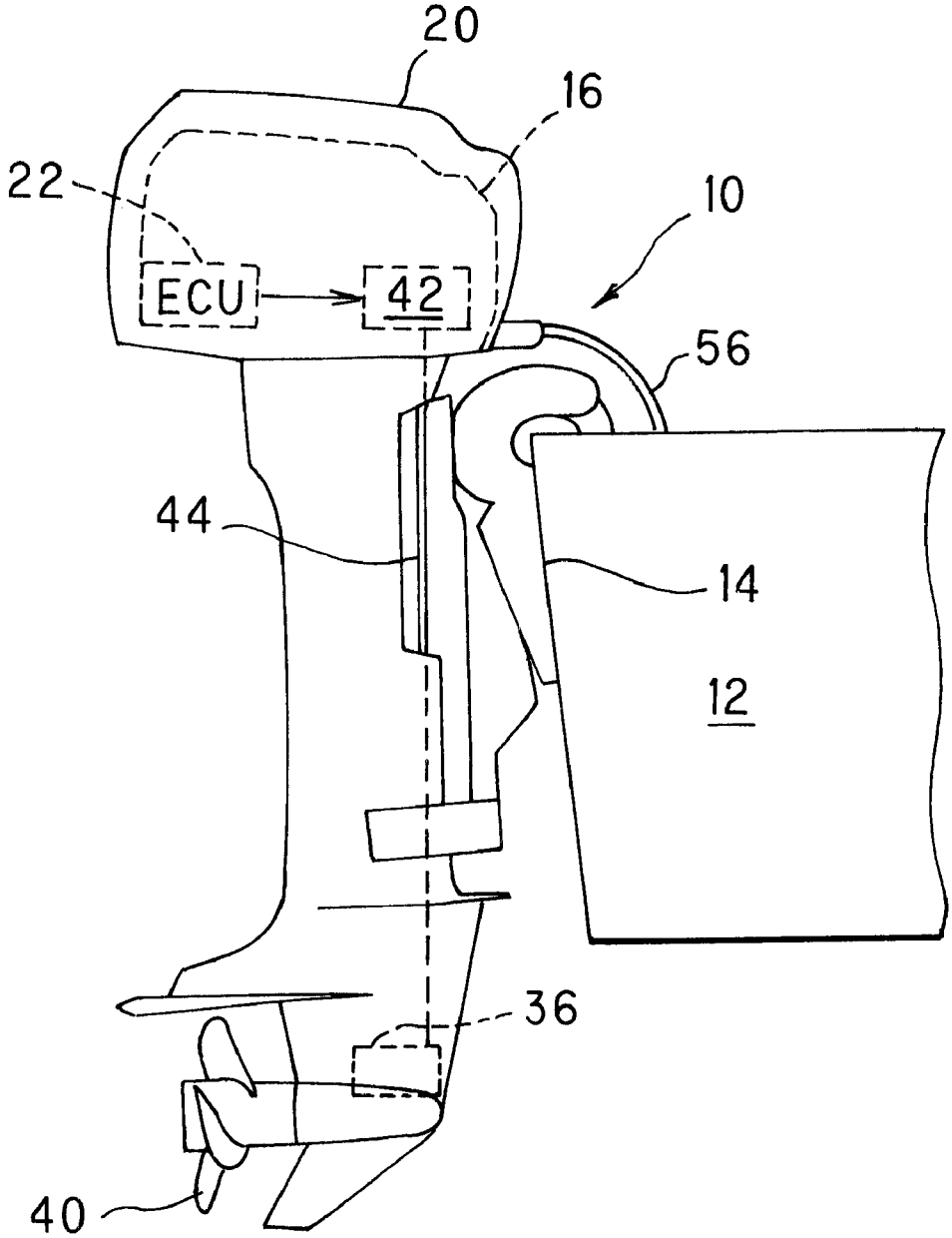
FIG. 2 is an enlarged side view of one portion of FIG. 1.

FIG. 1 is a schematic view showing the overall configuration of the idling speed control system for an outboard motor and FIG. 2 is an enlarged side view of one portion of FIG. 1.

Reference numeral 10 in FIGS. 1 and 2 designates the aforesaid propulsion unit including an internal combustion engine, propeller shaft and propeller integrated into what is hereinafter called an "outboard motor." The outboard motor 10 is mounted on the stern of a boat (small craft) 12 by a clamp unit 14 (see FIG. 2).

As shown in FIG. 2, the outboard motor 10 is equipped with the internal combustion engine (hereinafter called the "engine") 16. The engine 16 is a spark-ignition V-6 gasoline engine. The engine is positioned above the water surface and is enclosed by an engine cover 20 of the outboard motor 10. An electronic control unit (ECU) 22 composed of a microcomputer is installed near the engine 16 enclosed by the engine cover 20.

As shown in FIG. 1, a steering wheel 24 is installed in the cockpit of the boat 12. When the operator turns the steering wheel 24, the rotation is transmitted to a rudder (not shown) fastened to the stern through a steering system not visible in the drawings, changing the direction of boat advance.

A throttle lever 26 is mounted on the right side of the cockpit and near it is mounted a throttle lever position sensor 30 that outputs a signal corresponding to the position of the throttle lever 26 set by the operator.

A shift lever 32 is provided adjacent to the throttle lever 26 and next to it is installed a neutral switch 34 that outputs an ON signal when the operator puts the shift lever 32 in Neutral and outputs an OFF signal when the operator puts the shift lever 32 in Forward or Reverse. The outputs from the throttle lever position sensor 30 and neutral switch 34 are sent to the ECU 22 through signal lines 30*a* and 34*a*.

The output of the engine 16 is transmitted through a crankshaft and a drive shaft (neither shown) to a clutch 36 of the outboard engine 10 located below the water surface. The clutch 36 is connected to a propeller 40 through a propeller shaft (not shown).

The clutch 36, which comprises a conventional gear mechanism, is omitted from the drawing. It is composed of a drive gear that rotates unitarily with the drive shaft when the engine 16 is running, a forward gear, a reverse gear, and a dog (sliding clutch) located between the forward and reverse gears that rotates unitarily with the propeller shaft. The forward and reverse gears are engaged with the drive gear and rotate idly in opposite directions on the propeller shaft.

The ECU 22 is responsive to the output of the neutral switch 34 received on the signal line 34*a* for driving an actuator (electric motor) 42 via a drive circuit (not shown) so as to realize the intended shift position. The actuator 42 drives the dog through a shift rod 44.

When the shift lever 32 is put in Neutral, the engine 16 and the propeller shaft are disconnected and can rotate independently. When the shift lever 32 is put in Forward or Reverse position, the dog is engaged with the forward gear or the reverse gear and the rotation of the engine 16 is transmitted through the propeller shaft to the propeller 40 to drive the propeller 40 in the forward direction or the opposite (reverse) direction and thus propel the boat 12 forward or backward.

The engine 16 will now be explained with reference to FIGS. 3 and 4.

Figure 3:
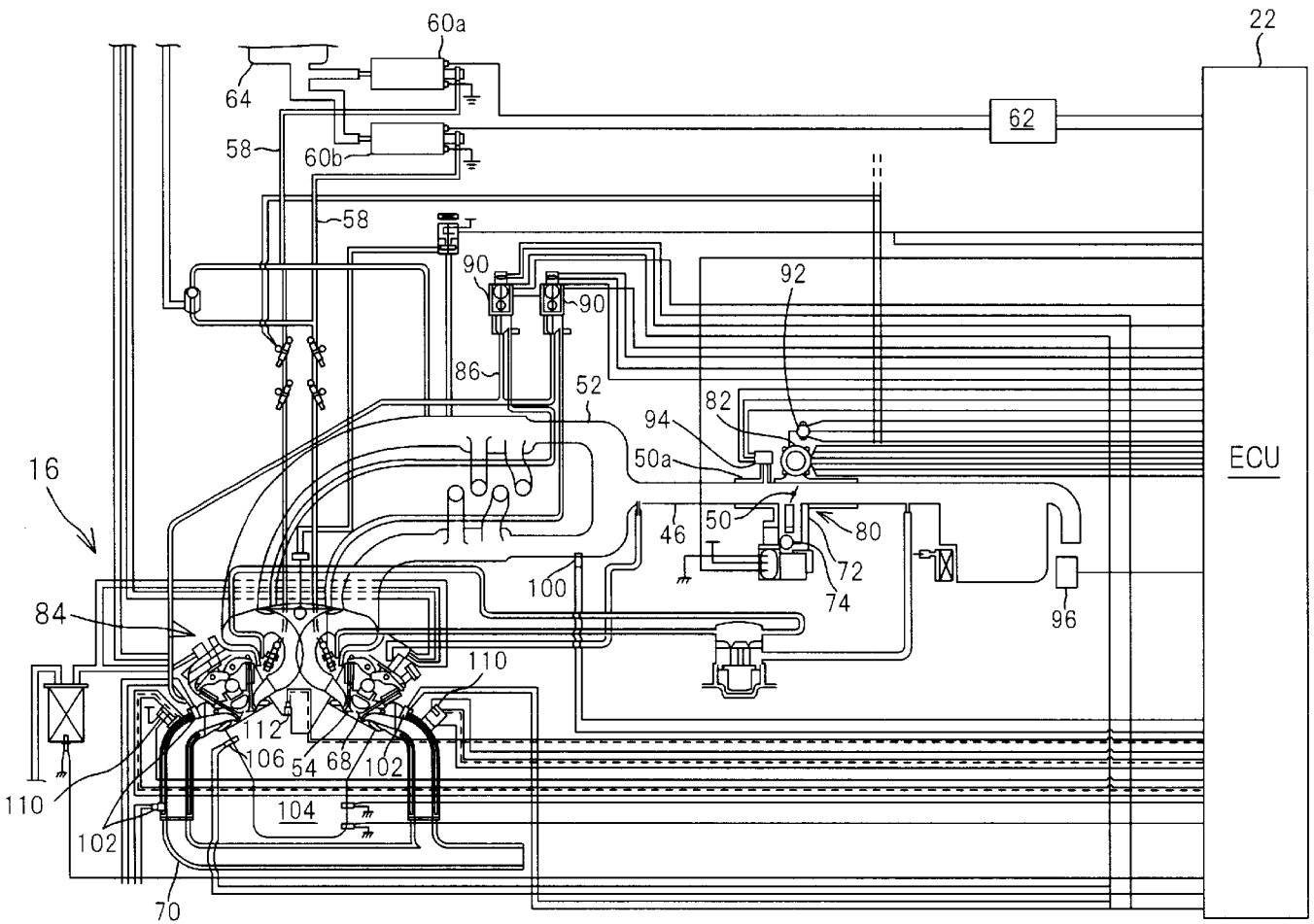
FIG. 3 is a schematic diagram showing details of the engine of the motor shown in FIG. 1.

As shown in FIG. 3, the engine 16 is equipped with an air intake pipe 46. Air drawn in through an air cleaner (not shown) is supplied to intake manifolds 52 provided one for each of left and right cylinder banks disposed in V-like shape as viewed from the front, while the flow thereof is adjusted by a throttle valve 50, and finally reaches an intake valves 54 of the respective cylinders. An injector 56 (not shown in FIG. 3) is installed in the vicinity of each intake valve (not shown) for injecting fuel (gasoline).

The injectors 56 are connected through two fuel lines 58 provided one for each cylinder bank to a fuel tank (not shown) containing gasoline. The fuel lines 58 pass through separate fuel pumps 60*a* and 60*b* equipped with electric motors (not shown) that are driven via a relay circuit 62 so as to send pressurized gasoline to the injectors 56. Reference numeral 64 designates a vaporized fuel separator.

The intake air is mixed with the injected gasoline to form an air-fuel mixture that passes into the combustion chamber (not shown) of each cylinder, where it is ignited by a spark plug 66 (not shown in FIG. 3) to burn explosively and drive down a piston (not shown). The so-produced engine output is taken out through a crankshaft. The exhaust gas produced by the combustion passes out through exhaust valves 68 into exhaust manifolds 70 provided one for each cylinder bank and is discharged to the exterior of the engine.

As illustrated, a branch passage 72 for secondary air supply is formed to branch off from the air intake pipe 46 upstream of the throttle valve 50 and rejoin the air intake pipe 46 downstream of the throttle valve 50. The branch passage 72 is equipped with an electronic secondary air control valve (EACV) 74.

The EACV 74 is connected to the ECU 22. As explained further later, the ECU 22 calculates a current command value that it supplies to the EACV 74 so as to drive the EACV 74 for regulating the opening of the branch passage 72. The branch passage 72 and the EACV 74 thus constitute a secondary air supplier 80 for supplying secondary air in proportion to the opening of the EACV 74.

The throttle valve 50 is connected to an actuator (stepper motor) 82. The actuator 82 is connected to the ECU 22. The ECU 22 calculates a current command value proportional to the output of the throttle lever position sensor 30 and supplies it to the actuator 82 through a drive circuit (not shown) so as to regulate the throttle opening or position TH.

More specifically, the actuator 82 is directly attached to a throttle body 50*a* housed in the throttle valve 50 with its rotating shaft (not shown) oriented to be coaxial with the throttle valve shaft. In other words, the actuator 82 is attached to the throttle body 50*a* directly, not through a linkage, so as to simplify the structure and save mounting space.

Thus, in this embodiment, the push cable is eliminated and the actuator 82 is directly attached to the throttle body 50*a* for driving the throttle valve 50.

The engine 16 is provided in the vicinity of the intake valves 54 and the exhaust valves 68 with a variable valve timing system 84. When engine speed and load are relatively high, the variable valve timing system 84 switches the valve open time and lift to relatively large values (Hi V/T). When the engine speed and load are relatively low, it switches the valve open time and lift to relatively small values (Lo V/T).

The exhaust system and the intake system of the engine 16 are connected by EGR (exhaust gas recirculation) passages 86 provided therein with EGR control valves 90. Under predetermined operating conditions, a portion of the exhaust gas is returned to the air intake system.

The actuator 82 is connected to a throttle position sensor 92 responsive to rotation of the throttle shaft for outputting a signal proportional to the throttle opening or opening TH. A manifold absolute pressure sensor 94 is installed downstream of the throttle valve 50 for outputting a signal proportional to the manifold absolute pressure PBA in the air intake pipe (engine load). In addition, an atmospheric air pressure sensor 96 is installed near the engine 16 for outputting a signal proportional to the atmospheric air pressure PA.

An intake air temperature sensor 100 installed downstream of the throttle valve 50 outputs a signal proportional to the intake air temperature TA. Three overheat sensors 102 installed in the exhaust manifolds 70 of the left and right cylinder banks output signals proportional to the engine temperature. A coolant temperature sensor 106 installed at an appropriate location near the cylinder block 104 outputs a signal proportional to the engine coolant temperature TW.

$O_2$ sensors 110 installed in the exhaust manifolds 70 output signals reflecting the oxygen concentration of the exhaust gas. A knock sensor 112 installed at a suitable location on the cylinder block 104 outputs a signal related to knock.

Figure 4:
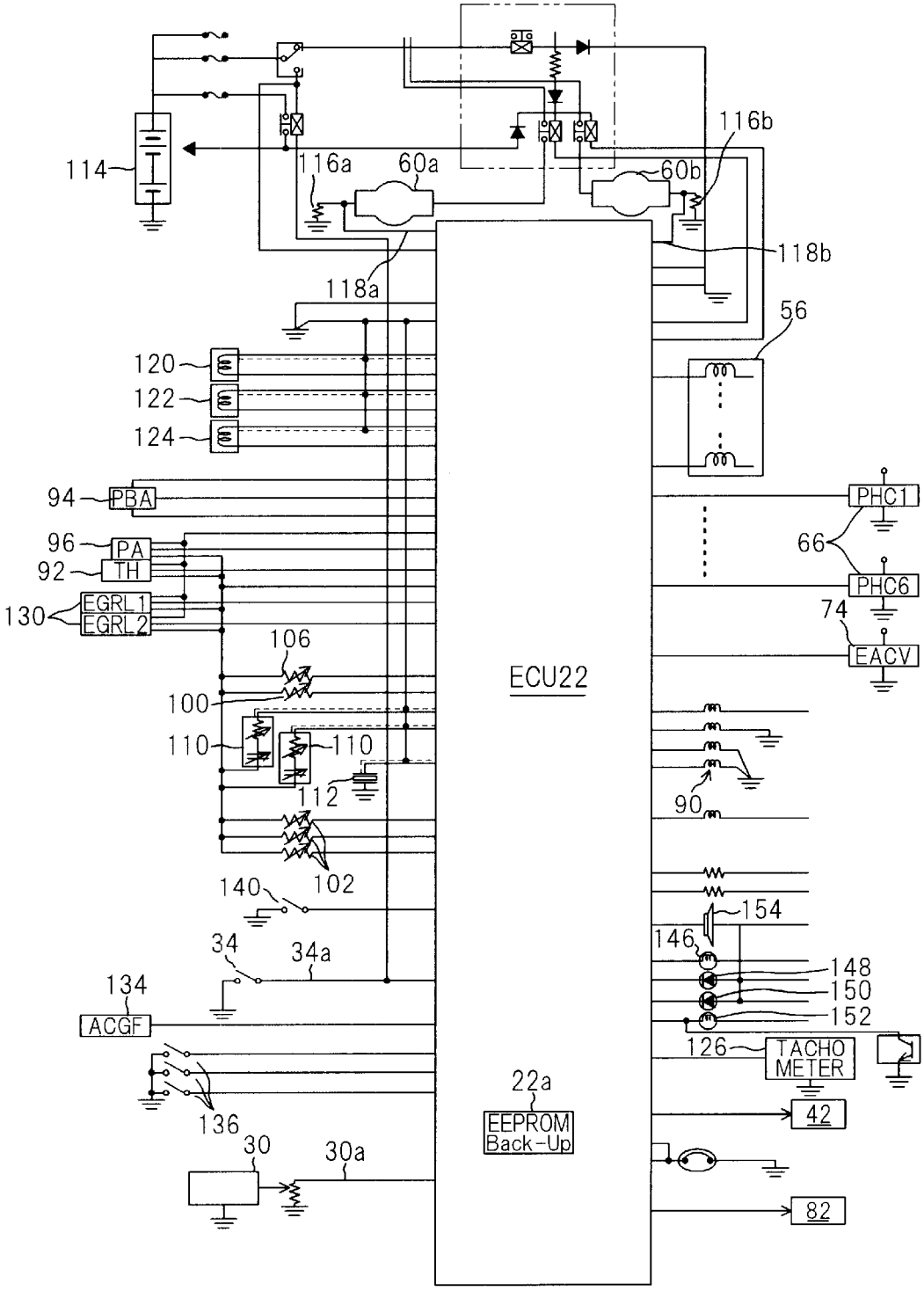
FIG. 4 is a block diagram setting out the particulars of inputs/outputs to and from the electronic control unit (ECU) shown in FIG. 1.

The explanation of the outputs of the sensors and the inputs/outputs to/from the ECU 22 will be continued with reference to FIG. 4. Some sensors and signals lines do not appear in FIG. 3.

The motors of the fuel pumps 60*a* and 60*b* are connected to an onboard battery 114 and detection resistors 116*a* and 116*b* are inserted in the motor current supply paths. The voltages across the resistors are input to the ECU 22 through signal lines 118*a* and 118*b*. The ECU 22 determines the amount of current being supplied to the motors from the voltage drops across the resistors and uses the result to discriminate whether any abnormality is present in the fuel pumps 60*a* and 60*b*.

TDC (top dead center) sensors 120 and 122 and a crank angle sensor 124 are installed near the engine crankshaft for producing and outputting to the ECU 22 cylinder discrimination signals, angle signals near the top dead centers of the pistons, and a crank angle signal once every 30 degrees. The ECU 22 calculates the engine speed NE from the output of the crank angle sensor. Lift sensors 130 installed near the EGR control valves 90 produce and send to the ECU 22 signals related to the lifts (valve openings) of the EGR control valves 90.

The output of the F terminal (ACGF) 134 of an AC generator (not shown) is input to the ECU 22. Three hydraulic (oil pressure) switches 136 installed in the hydraulic circuit (not shown) of the variable valve timing system 84 produces and outputs to the ECU 22 a signal related to the detected hydraulic pressure. A hydraulic switch 140 installed in the hydraulic circuit (not shown) of the engine 16 produces and outputs to the ECU 22 a signal related to the detected hydraulic pressure.

The ECU 22, which is composed of a microcomputer as mentioned earlier, is equipped with an EEPROM (electrically erasable and programmable read-only memory) 22*a* for back-up purposes. The ECU 22 uses the foregoing inputs to carry out processing operations explained later. It also turns on a PGM lamp 146 when the PGM (program/ECU) fails, an overheat lamp 148 when the engine 16 overheats, a hydraulic lamp 150 when the hydraulic circuit fails and an ACG lamp 152 when the AC generator fails. Together with lighting these lamps it sounds a buzzer 154. Explanation will not be made with regard to other components appearing in FIG. 4 that are not directly related to the substance of this invention.

The operation of the illustrated idling speed control system for an outboard motor will now be explained.

Figure 5:
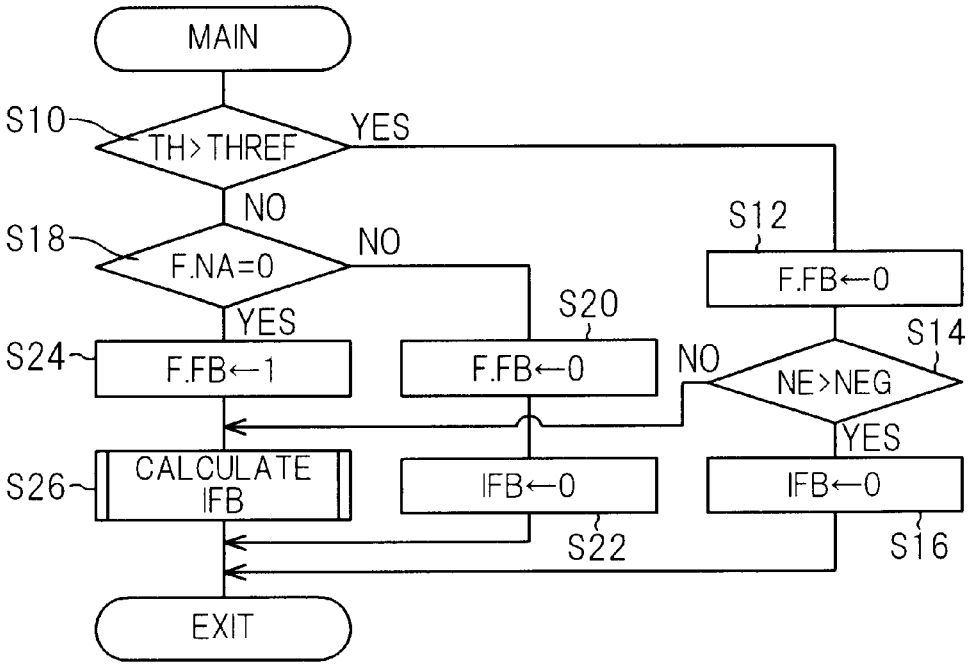
FIG. 5 is a main flow chart showing the sequence of operations for calculating a current command value for a secondary air control valve (a value representing a desired amount of secondary air) during operation of the idling speed control system for the engine of the motor shown in FIG. 1.

FIG. 5 is a main flow chart showing the sequence of operations of the system. The illustrated program is activated once every 40 msec, for example.

In S10 it is checked whether the detected throttle opening TH is greater than or equal to a predetermined opening THREF (at or near zero). In other words, it is discriminated whether or not the engine 16 is in the idling region. When the result is YES, the program proceeds to S12 in which the bit of a flag F.FB is reset to zero. Resetting the bit of the flag F.FB to zero indicates that no feedback control of the idling speed (i.e., the engine speed control during idling) is to be conducted.

Next, in S14, it is checked whether the detected engine speed NE is greater than a predetermined protective engine speed NEG (e.g., 5000 rpm). When the result is YES, the program proceeds to S16 in which a current command value IFB (more precisely, the current command value during idling speed feedback control) is set to zero. In this way, the desired amount of supplied secondary air is expressed as a current command value for the EACV 74. Since secondary air is therefore supplied to the cylinder combustion chambers in an amount proportional to the current command value, the quantity of fuel injection is increased/reduced proportionally to increase/reduce the engine speed (rpm). More specifically, the inflow of secondary air changes the pressure in the intake pipe in the same way that opening/closing the throttle does and, therefore, the quantity of fuel injection and the engine speed are increased/decreased in proportion.

When the result in S10 is NO and it is found that the engine 16 is in the idling region, the program proceeds to S18 in which it is checked whether the bit of a flag F.NA is reset to zero. The setting/resetting of the bit of the flag F.NA is conducted by a separate routine (not shown in the drawings), which resets the bit to zero when the detected engine speed NE is at or below feedback execution speed NA (e.g., 1000 rpm).

Figure 6:
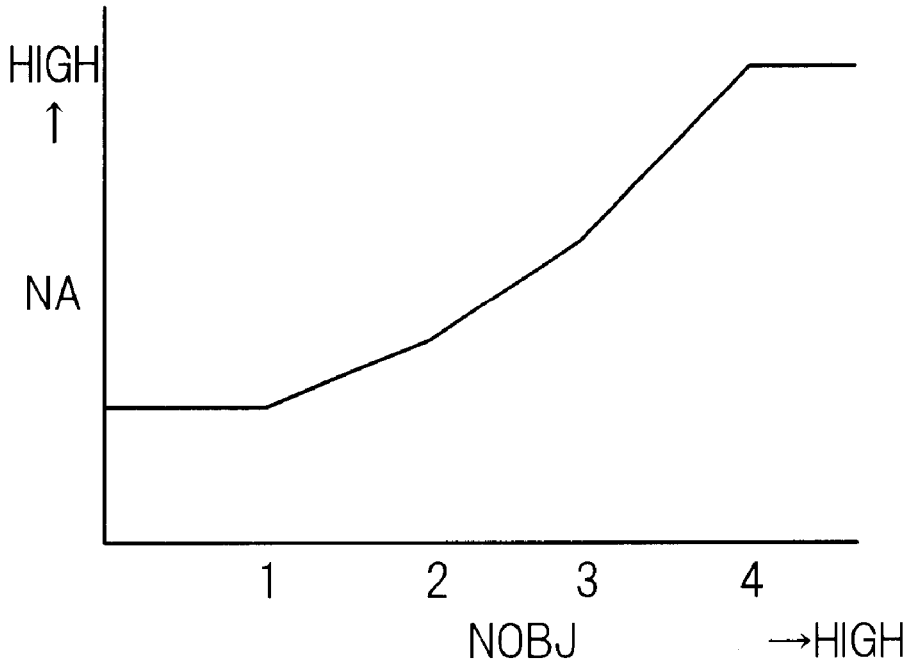
FIG. 6 is a graph for explaining the characteristic of a feedback execution speed NA referred to in the flow chart of FIG. 5.

FIG. 6 is a graph for explaining the characteristic of the feedback execution speed NA. The feedback execution speed NA is set lower than the predetermined engine speed NEG and defined so as to increase in proportion to the desired idling speed (hereinafter referred to as desired idling speed NOBJ), which will be explained later.

When the result in S18 is NO, i.e., when the detected engine speed NE is found to be relatively high, in other words, when the engine 16 is decelerating, the program proceeds to S20 in which the bit of the flag F.FB is reset to zero, and to S22 in which the current command value IFB is set to zero. When the result in S18 is YES, i.e., when the engine speed NE is found to be relatively low, the program proceeds to S24 in which the bit of the flag F.FB is set to 1. The setting of the bit of the flag to 1 indicates that feedback control is to be executed. Next, in S26, the current command value IFB is calculated. It is also calculated when the result in S14 is NO, more specifically, when the engine 16 is accelerating at a speed not more than NEG or the engine 16 is under steady state.

Figure 7:
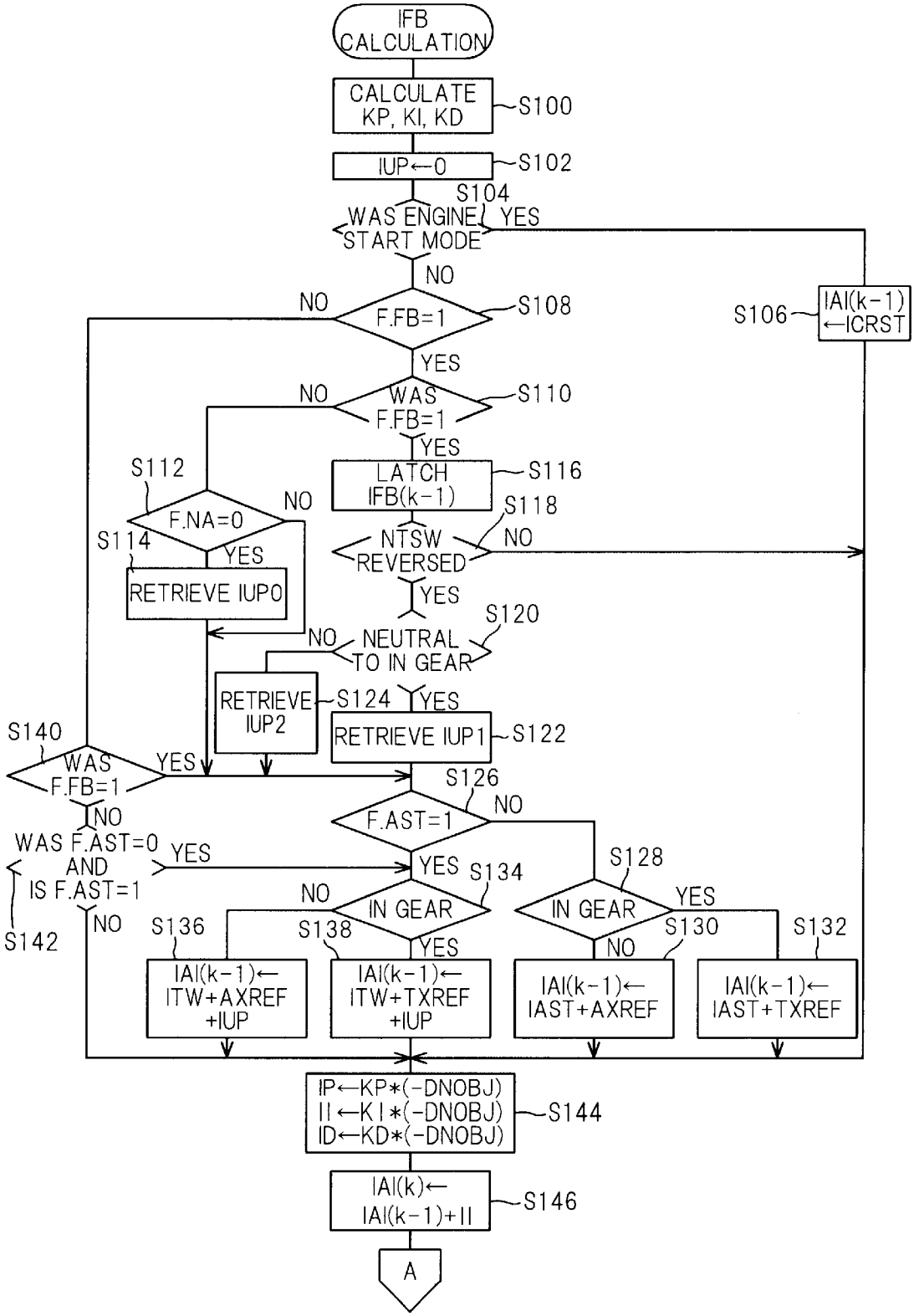
FIG. 7 is the former half of a subroutine flow chart showing the sequence of operations for calculating the current command value IFB in the flow chart of FIG. 5.
Figure 8:
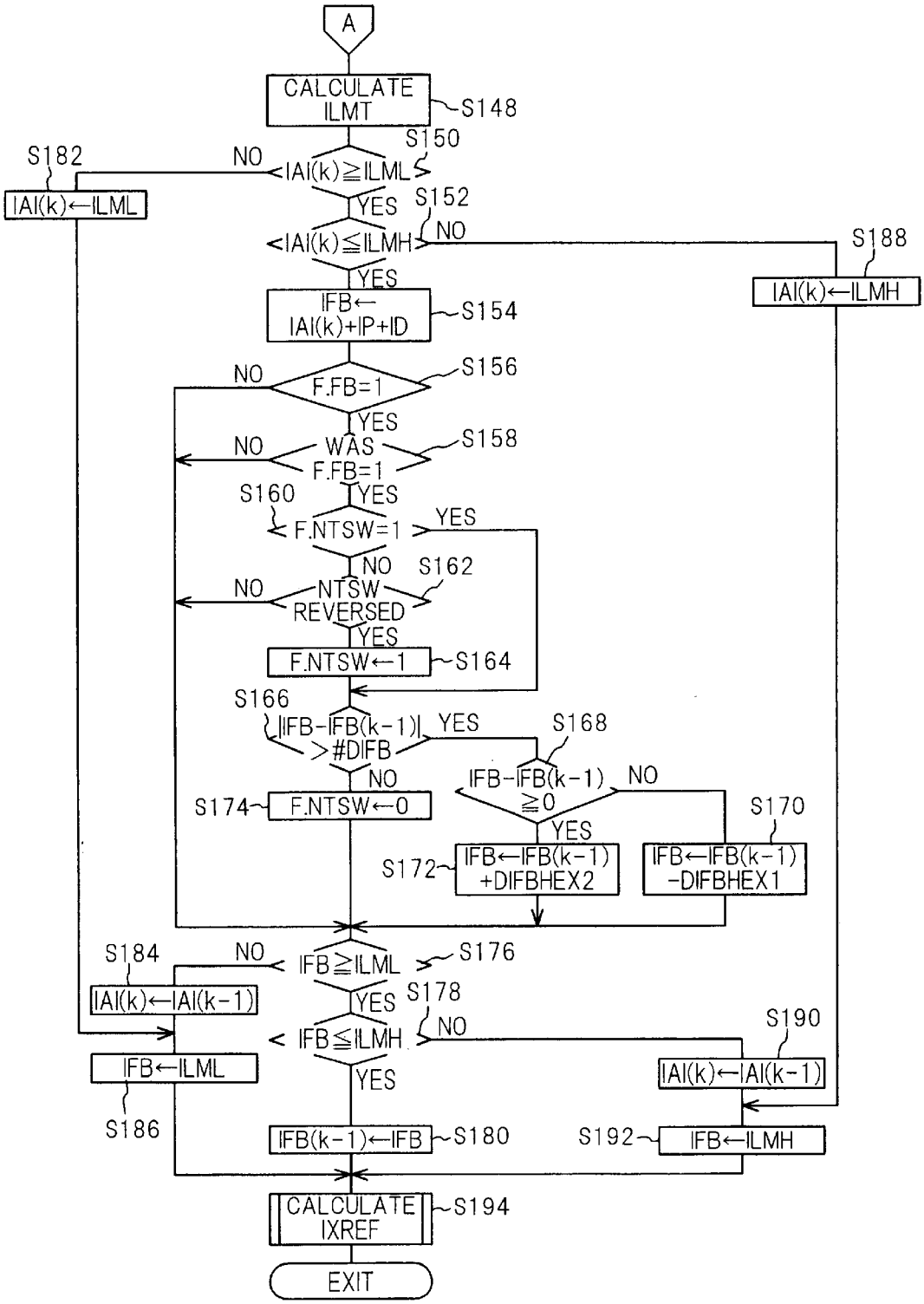
FIG. 8 is the latter half of the subroutine flow chart showing the sequence of operations for calculating the current command value IFB in the flow chart of FIG. 5.

FIGS. 7 and 8 show a subroutine flow chart of the sequence of operations for calculating the current command value IFB in S26 of the flow chart of FIG. 6.

In S100, correction coefficients KP, KI and KD are calculated. The program then proceeds to S102 in which an excessive change correction value IUP is set to zero.

Next, in S104, it is determined whether the engine 16 was in start mode in the preceding control cycle, i.e., during the preceding program loop of the flow chart of FIG. 5. This is determined by checking whether the detected engine speed NE had reached full-firing speed. When the result in S104 is YES, the program proceeds to S106 in which a base current command value IAI is set to a predetermined engine start time value ICRST.

When the result in S104 is NO, the program proceeds to S108 in which it is checked whether the bit of the flag F.FB is set to 1. When the result is YES, the program proceeds to S110 in which it is checked whether the bit of the flag F.FB was also 1 in the preceding control cycle. When the bit was first set to 1 in the present (current) control cycle (program loop), the result in S110 is NO and the program proceeds to S112 in which it is checked whether the bit of the flag F.NA is 0.

When the result in S112 is YES, the detected engine speed NE is below the feedback execution speed NA and the program therefore proceeds to S114 in which the excessive change correction value IUP0 is determined by retrieval from an IUP0 table (whose characteristic is not shown) using the intake air temperature TA as the address. S114 is skipped when the result in S112 is NO.

When the result in S110 is YES, meaning that feedback control was also executed in the preceding control cycle, the program proceeds to S116 in which the preceding current command value IFB(k−1) is latched, and to S118 in which it is checked whether the output of the neutral switch 34 (illustrated as "NTSW" in the figure) reversed, i.e., whether the shift lever 32 was shifted from Neutral to Forward (or Reverse) or from Forward (or Reverse) to Neutral. When the result in S118 is YES, the program proceeds to S120 in which it is checked whether a shift was made from Neutral to an IN GEAR (geared) state, i.e., from Neutral to Forward (or Reverse).

When the result in S120 is YES, the program proceeds to S122 in which the excessive change correction value IUP1 is retrieved from an IUP1 table (whose characteristic is not shown) using the detected intake air temperature TA as an address. When the result in S120 is NO, the program proceeds to S124 in which the excessive change correction value IUP2 is retrieved from an IUP2 table (whose characteristic is not shown) using the intake air temperature TA as an address. The excessive change correction values of the tables IUPn are defined such that IUP0>IUP1>IUP2.

This is because IUP0, IUP1, and IUP2 are respectively tables from which the excessive change correction value IUP is retrieved when the engine speed is on the decline, during load, and during no load. The values of the IUP0 table must therefore be defined large to bring the engine speed NE back up to the proper level and the values of the IUP1 table need to be set larger than those of the IUP2 table.

Next, in S126, it is checked whether the bit of a flag F.AST is set to 1. The bit of this flag is set to 1 in a separate routine (not shown) in the post-start state of the engine 16. The "post-start state" of the engine 16 is defined as that when the detected engine speed NE has reached the full-firing speed (500 rpm).

When the result in S126 is NO, the program proceeds to S126 in which it is checked whether the shift lever 32 is in the IN GEAR state, i.e., whether it has been put in Forward (or Reverse). When the result is NO, the program proceeds to S130 in which the sum of a correction value IAST and an idling learning control value (desired amount of secondary air required during idling) AXREF (explained later) is defined as the base value of the preceding control cycle IAI(k−1).

When the result in S128 is YES, the program proceeds to S132 in which the sum of the correction value (air amount required immediately after start) IAST and a trolling learning control value (desired amount of secondary air required during trolling) TXREF (explained later) is defined as the base value of the preceding control cycle LAI(k−1).

As termed in this specification and the drawings, "trolling" means moving of the boat 12 forward or backward with the shift lever 32 put in Forward (or Rearward) and the throttle at full closed. In other words, it means moving of the boat 12 forward or backward at very low speed with the engine 16 in the idling state.

As used in this specification and the drawings, the suffix k indicates sampling time in discrete-time series, particularly program loop time in the flow chart of FIG. 5. Still more specifically, a value suffixed with (k) is that during the present control cycle and a value suffixed with (k−1) is that during the preceding control cycle. For simplicity, the suffix (k) is omitted except when necessary to avoid confusion.

When the result in S126 is YES, the program proceeds to S134 in which it is checked whether the shift lever 32 is in the IN GEAR state, i.e., whether it has been put in Forward (or Reverse). When the result in S134 is NO, the program proceeds to S136 in which the sum of a coolant correction value ITW, the idling learning control value (desired amount of secondary air required during idling) AXREF (explained later) and the excessive change correction value IUP is defined as the base value of the preceding control cycle IAI(k−1).

When the result in S134 is YES, the program proceeds to S138 in which the sum of the coolant correction value ITW, the trolling learning control value (desired amount of secondary air required during trolling) TXREF (explained later) and the excessive change correction value IUP is defined as the base value of the preceding control cycle IAI(k−1).

The idling learning control value (desired amount of secondary air required during idling) AXREF and trolling learning control value (desired amount of secondary air required during trolling) TXREF are assigned the generic symbol IXREF. Calculation of the learning control values is explained later.

When the result in S108 is NO, such as when the program passes from S14 to S26 in the flow chart of FIG. 5, the program proceeds to S140 in which it is checked whether the bit of the flag F.FB was set to 1 in the preceding control cycle. When the result in S140 is YES, i.e., when the bit of the flag F.FB has not been reset to 0 continuously but only in the present control cycle, the program proceeds to S126. When the result in S140 is NO, the program proceeds to S142 in which it is checked whether the bit of the flag F.AST was 0 in the preceding control cycle and changed to 1 in the present control cycle. When the result in S140 is YES, the program proceeds to S134.

The program next proceeds to S144 in which the difference or deviation-DNOBJ between the detected engine speed NE and the desired idling speed NOBJ (explained later) is calculated and multiplied by the aforesaid correction coefficients to obtain a proportional correction value IP, integral correction value II and derivative correction value ID. The same applies when the processing of S106 has been carried out and when the result in S142 is NO.

Next, in S146, the calculated integral correction value II is added to the base current command value of the preceding control cycle IAI(k−1) to obtain the base current command value in the present control cycle IAI(k). Next, in S148 (FIG. 8), limit values ILMT, more specifically a lower limit value ILML and an upper limit value ILMH, are retrieved. Next, in S150, it is checked whether the calculated base current command value IAI(k) is greater than or equal the retrieved lower limit value ILML. When the result is YES, the program proceeds to S152 in which it is checked whether the calculated base current command value IAI(k) is less than or equal to the retrieved upper limit value ILMH.

When the result in S152 is YES, the program proceeds to S154 in which the proportional correction value IP and the derivative correction value ID are added to the calculated base current command value IAI(k) and the sum obtained is defined as the current command value IFB.

Figure 9:
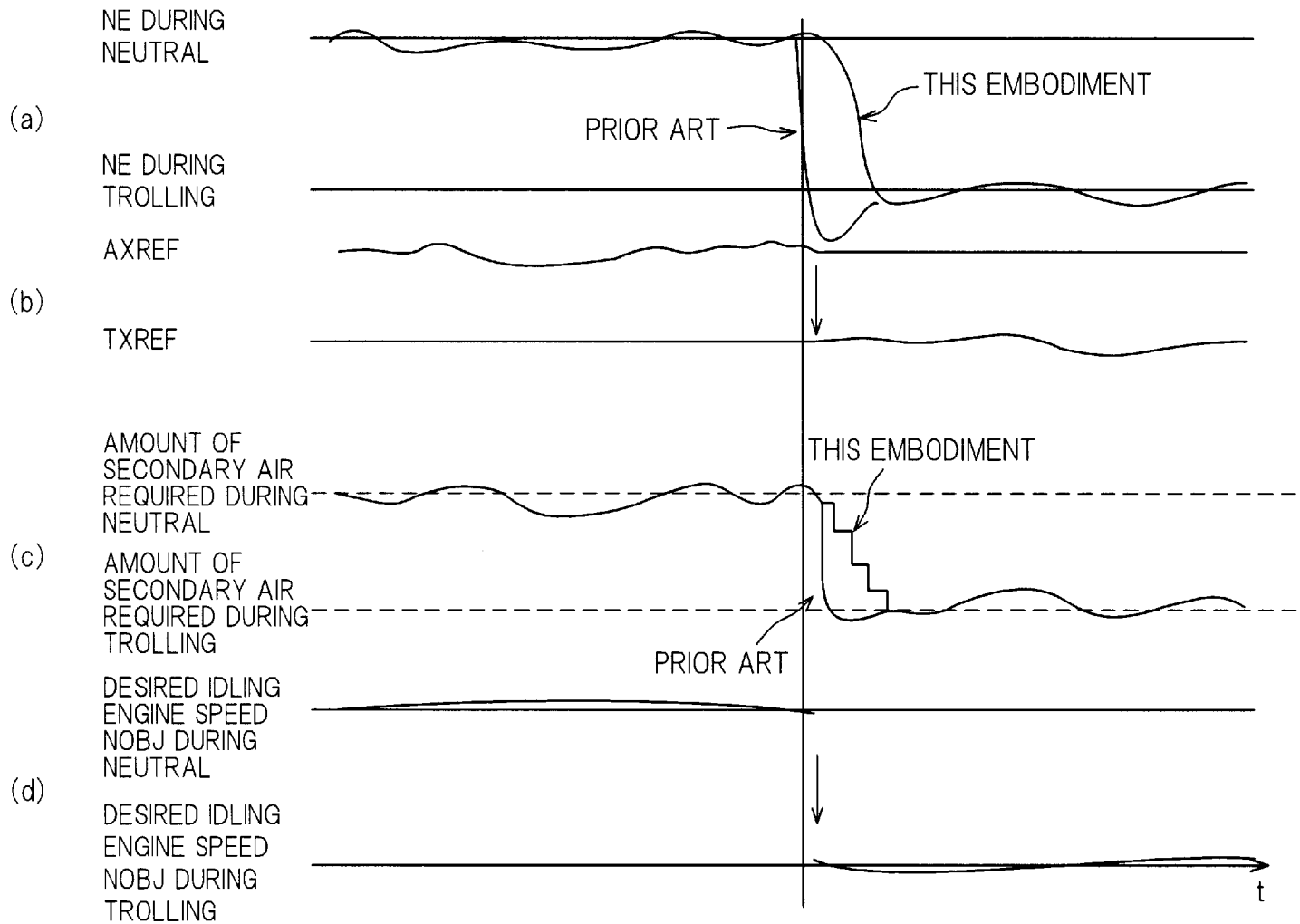
FIG. 9 is a time chart for explaining, inter alia, processing conducted in the subroutine flow chart of FIGS. 7 and 8.

The explanation of the flow chart of FIG. 8 will be interrupted at this point to explain this control with reference to the time chart of FIG. 9.

As shown at (a) in FIG. 9 and as was pointed out earlier, when the shift lever 32 is shifted from Neutral to Forward (or reverse), the engine speed NE falls, for instance, from 750 rpm to 650 rpm. In the conventional system, the abrupt change in engine speed this produces the aforesaid overshooting or undershooting of engine speed and causes the operator to experience an unpleasant feeling.

In this embodiment, therefore, learning control values are utilized and, as shown (b) in the same figure, the learning control value is changed according to the shift position. Therefore, as shown at (a) in the figure, the engine speed NE can be smoothly varied and stable low-speed operation can be achieved during trolling. As shown at (d), in this embodiment, the desired idling speed NOBJ is varied in response to the position of clutch (shift), which will be explained later.

In addition, as shown at (c) in the figure, when the engine speed is likely to change sharply, to be more specific, when the difference between the current command values IFB in the preceding control cycle and the present control cycle becomes large, the current command value IFB (i.e., the amount of secondary air) is decreased or increased such that the engine speed NE converges to the desired speed gradually or stepwise so as to suppress the overshooting or undershooting of engine speed. With this, it becomes possible to eliminate or reduce due to the clutch change (shift change) and to improve the feeling experienced by the operator.

Returning to the explanation of the flow chart of FIG. 8, the program proceeds to S156 in which it is determined whether the bit of the flag FB is set to 1 and if YES, proceeds to S158 in which it is determined whether the bit of the flag F.FB was 1 in the preceding control cycle (program loop).

When the result in S158 is YES, the program proceeds to S160 in which it is determined whether the bit of a flag F.NTSW (explained later) is set to 1. When the result is NO, the program proceeds to S162 in which it is determined whether the output of the neutral switch 34 reversed and when the result is YES, the program proceeds to S164 in which the bit of the flag F.NTSW is set to 1. Thus, the flag F.NTSW is a latch flag which indicates whether the output of the neutral switch 34 reversed, and the bit is set to 1 each time the switch output reverse irrespectively of the direction (i.e., from Neutral to the IN GEAR state (Forward or Reverse) or vice versa). When the result in S160 is YES, the program skips S162 and S164.

Then the program proceeds to S166 in which it is determined whether the absolute value of the difference obtained by subtracting the current command value in the preceding control cycle IFB(k−1) from the calculated current command value in this control cycle IFB, is greater than a predetermined value #DIFB, in other words, it is determined whether the difference is large.

The predetermined value #DIFB is set to be varied with the load exerted on the engine 16. More specifically, #DIFB is set to be increased with increasing load and is replaced with (changed by) the calculated learning control value IXREF, the detected absolute manifold pressure PBA, etc. With this, it becomes possible to take the change of the amount of secondary air due to the fluctuation of load into account and to make the transient time from the idling speed to the trolling speed (and vice versa) constant. This can improve the feeling experienced by the operator.

When the result in S166 is YES, the program proceeds to S168 in which it is determined whether the difference between the present value and the preceding value is greater than or equal to zero, in other words, it is determined whether it is on the increase (i.e., it changes in the increasing direction).

When the result in S168 is negative, the program proceeds to S170 in which the value obtained by subtracting a predetermined value DIFBHEX1 from the current command value of the preceding control cycle IFB(k−1) is defined as IFB. When the result in S168 is YES, the program proceeds to S172 in which the value obtained by adding a predetermined value DIFBHEX2 to the current command value of the preceding control cycle IFB(k−1) is defined as IFB.

Figure 10:
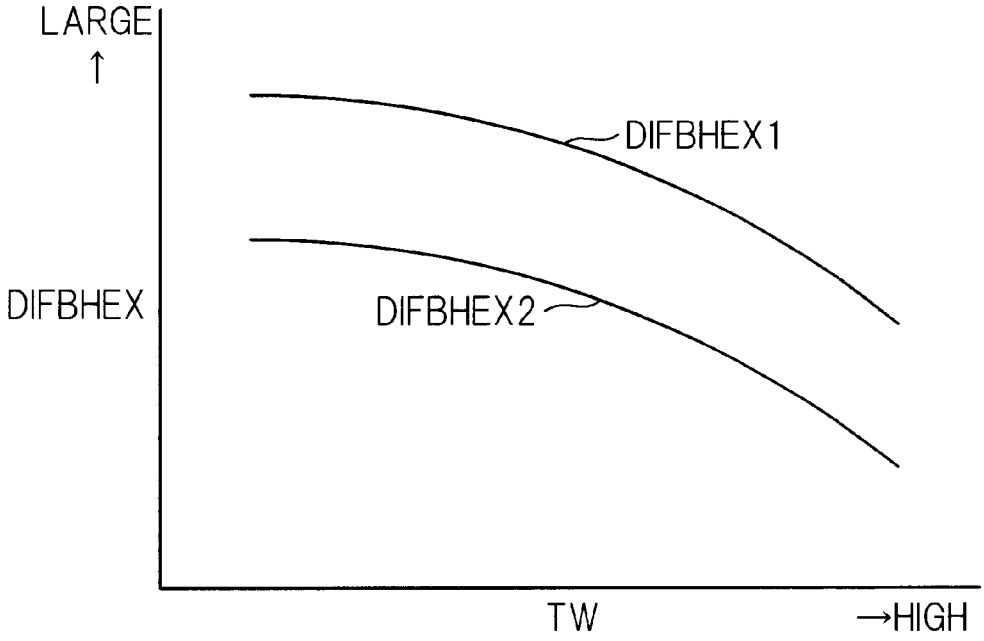
FIG. 10 is a graph for explaining the characteristic of predetermined values DIFBHEX 1, 2 referred to in the flow chart of FIG. 8.

As illustrated in FIG. 10, the values #DIFBHEX1 for subtraction and #DIFBHEX2 for addition are set relative to the engine coolant temperature TW. To be more specific, since the control response improves as the temperature increases, the values are set to be finer or smaller with increasing temperature. With this, it becomes possible to conduct finer control until the engine speed reaches the desired speed at a high engine coolant temperature. Accordingly, it becomes possible to switch the engine speed from the idling to trolling (and vice versa) in a smoother manner and to give a better feeling to the operator.

Further, as illustrated in the figure, since the value DIFBHEX1 for subtraction is set to be larger than the value DIFBHEX2 for addition, it becomes possible to bring the engine speed to the trolling speed promptly when the clutch is shifted to the trolling position (Forward or Reverse), and to achieve a finer and smoother transitional speed to the idling speed when the clutch is shifted back to Neutral. With this, it becomes to further improve the feeling experienced by the operator. When the clutch is returned to Neutral, since more time is permitted than the case where the clutch is shifted in the trolling direction, no problem will occur when stages to return to the idling speed is made finer, i.e., when a time to return to the idling speed is prolonged.

Returning to the explanation of the flow chart of FIG. 8, when the result in S166 is NO, the program proceeds to S174 in which the bit of the flag F.NTSW is reset to 0.

Then the program proceeds to S176 in which it is determined whether the calculated current command value IFB is greater than or equal to the lower limit value ILML. This is the same when the result is NO in S156, S158, S160 and S162. When the result in S176 is YES, the program proceeds to S178 in which it is determined whether the calculated current command value IFB is less than or equal to the upper limit value ILMH. When the result is YES, the program proceeds to S180 in which the calculated current command of the present control cycle IFB is renamed that in the preceding control cycle IFB(k−1)

When the result in S150 is NO, the program proceeds to S182 in which the retrieved lower limit value ILML is defined as the base current command value of the present control cycle IAI(k). When the result in S176 is NO, the program proceeds to S184 in which the based current command value of the preceding control cycle IAI(k−1) is replaced with that of the present control cycle IAI(K) and proceeds to S186 in which the lower limit value ILML is defined as the current command value IFB.

When the result in S152 is NO, the program proceeds to S188 in which the retrieved upper limit value ILMH is defined as the base current command value of the present control cycle IAI(k). When the result in S178 is NO, the program proceeds to S190 in which the based current command value of the preceding control cycle IAI(k−1) is renamed that of the present control cycle IAI(k) and proceeds to S192 in which the upper limit value ILMH is defined as the current command value IFB.

The program next proceeds to S194 in which the learning control value IXREF is calculated. As was mentioned earlier, IXREF is a generic symbol for the idling learning control value AXREF and trolling learning control value TXREF.

Figure 11:
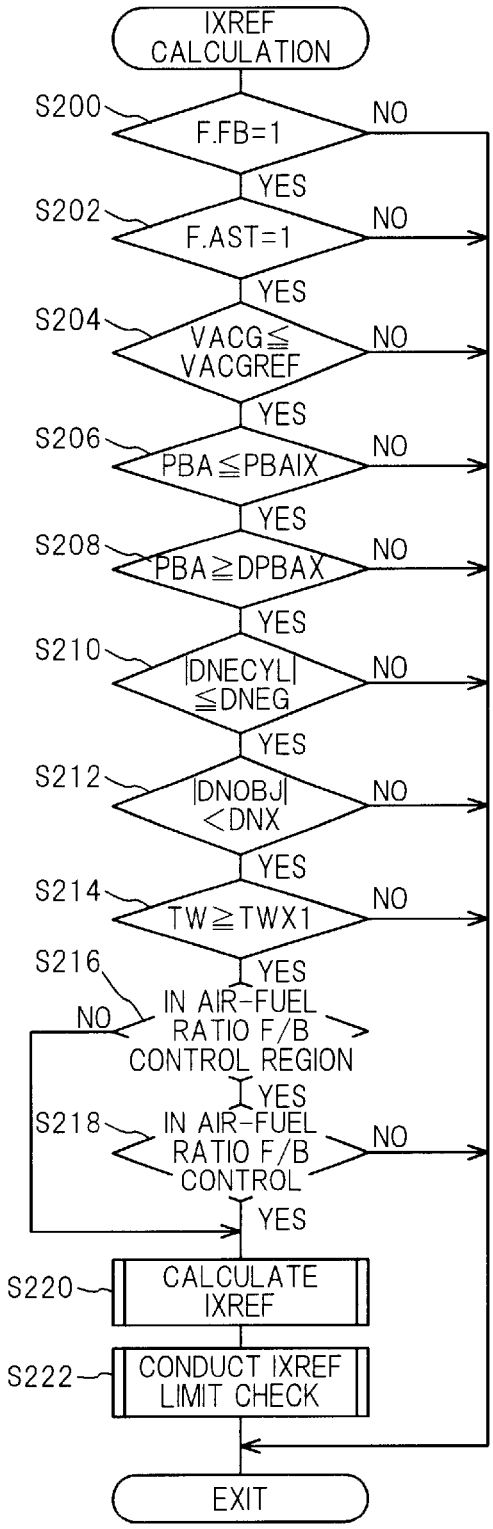
FIG. 11 is subroutine flow chart showing the sequence of operations for calculating the learning control value IXREF in the subroutine flow chart of FIG. 7.

FIG. 11 is subroutine flow chart showing the sequence of operations for calculating the learning control value IXREF.

In S200, it is checked whether the bit of the flag F.FB is set to 1, i.e., whether the system is in feedback mode. When the result is NO, the remaining steps in the subroutine are skipped.

Next, in S202, it is checked whether the bit of the flag F.AST is set to 1, i.e., whether the system is in post-start mode. When the result is NO, the remaining steps are skipped. When the result is YES, the program proceeds to S204 in which it is checked whether the voltage VACG at the F terminal 134 of the AC generator is less than or equal to a predetermined value VACGREF. When the result is NO, the remaining steps are skipped.

When the result in S204 is YES, the program proceeds to S206 in which it is checked whether the detected manifold absolute pressure PBA in the air intake pipe is less than or equal to a predetermined value PBAIX. When the result is NO, the remaining steps are skipped. When the result is YES, the program proceeds to S208 in which it is checked whether the detected manifold absolute pressure PBA in the air intake pipe is greater than or equal to a prescribe value DPBAX. When the result is NO, the remaining steps are skipped.

When the result in S208 is YES, the program proceeds to S210 in which the variation value DNECYCL of the detected engine speed NE during a predetermined combustion cycle (e.g., the first combustion cycle) is calculated as an absolute value and checked as to whether it is less than or equal to a predetermined value DNEG. When the result is NO, the remaining steps are skipped. When the result is YES, the program proceeds to S212 in which the variation value DNOBJ of the desired idling speed NOBJ is calculated as an absolute value and checked as to whether it is less than a predetermined value DNX. When the result is NO, the remaining steps are skipped.

When the result in S212 is YES, the program proceeds to S214 in which it is checked whether the detected engine coolant temperature TW is greater than or equal to a predetermined value TWX1. When the result is NO, the remaining steps are skipped. When the result is YES, the program proceeds to S216 in which, by referring to a suitable flag in a separate air-fuel ratio control routine (not shown), for example, it is checked whether the system is in an air-fuel ratio feedback region based on the outputs of the O2 sensors 110. When the result is YES, the program proceeds to S218 in which it is checked by a similar method whether air-fuel ratio feedback control is in effect. When the result in S216 is NO, S218 is skipped.

When the result in S218 is NO, the remaining steps are skipped. When it is YES, the program proceeds to S220 in which the learning control values IXREF are calculated.

Figure 12:
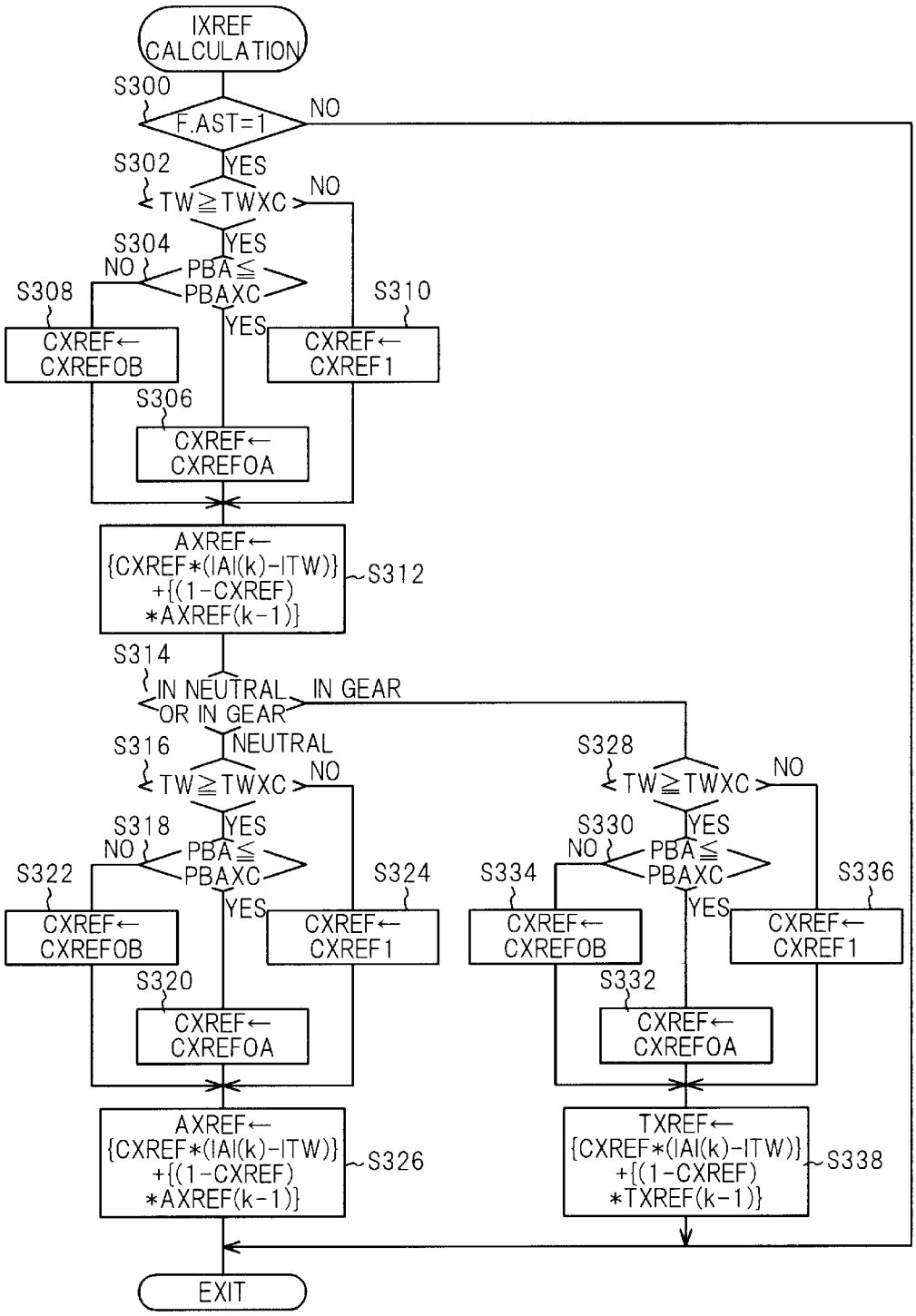
FIG. 12 is a subroutine flow chart showing the sequence of operations for calculating the learning control value IXREF in the subroutine flow chart of FIG. 11.

FIG. 12 is a subroutine flow chart showing the sequence of operations for this calculation.

In S300, it is checked whether the bit of the flag F.AST is set to 1, i.e., whether the system is in post-start mode. When the result is NO, the remaining steps are skipped. When the result in S300 is YES, the program proceeds to S302 in which it is checked whether the detected engine coolant temperature TW is greater than or equal to a predetermined value TWXC.

When the result in S302 is YES, meaning that the coolant temperature is high, the program proceeds to S304 in which it is checked whether the detected manifold absolute pressure PBA in the air intake pipe is less than or equal to a predetermined value PBAXC. When the result is YES, meaning that the load is low, the program proceeds to S306 in which the detected engine coolant temperature TW and the manifold absolute pressure PBA in the air intake pipe are used as address data for retrieving from a table, whose characteristic is shown in FIG. 13, a value CXREF0A that is defined as a smoothing coefficient CXREF.

Figure 13:
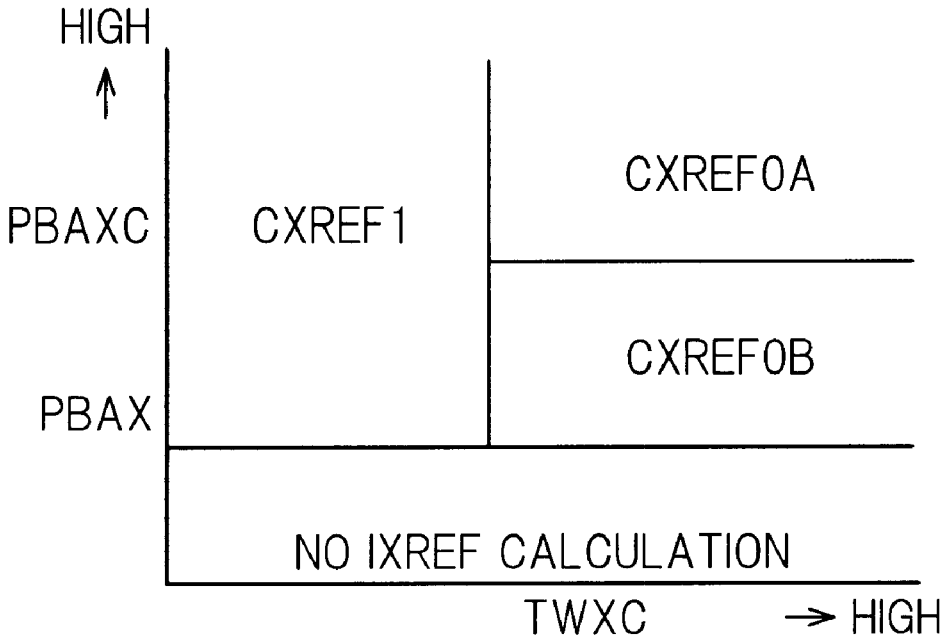
FIG. 13 is a graph for explaining the characteristic of a smoothing coefficient used to calculate the learning control value in the subroutine flow chart of FIG. 11.

When the result in S304 is NO, meaning the load is high, the program proceeds to S308 in which, similarly, the detected engine coolant temperature TW and the absolute pressure PBA in the air intake pipe are used as address data for retrieving from the table whose characteristic is shown in FIG. 13 a value CXREF0B that is defined as the smoothing coefficient CXREF.

When the result in S302 is NO, meaning that the coolant temperature is low, the program proceeds to S310 in which, similarly, the detected engine coolant temperature TW and the manifold absolute pressure PBA in the air intake pipe are used as address data for retrieving from the table whose characteristic is shown in FIG. 13 a value CXREF1 that is defined as the smoothing coefficient CXREF.

Next, in S312, the calculated smoothing coefficient and the base value etc. mentioned earlier are used to calculate the post-engine-start idling learning control value AXREF in accordance with the formula shown. The learning control value is thus calculated so as to smooth or temper the base current command value IAI (more specifically, the difference between it and the coolant correction value ITW) calculated for eliminating deviation between the desired idling speed NOBJ and the detected engine speed NE. In other words, the learning control value is calculated so that the desired amount of secondary air (required air amount) produces the desired idling speed NOBJ.

Next, in S314, it is checked whether the shift lever 32 is shifted to Neutral or to Forward (or Reverse). When it is found to be shifted to Neutral, the processing operations of S316 to S324 are carried out to calculate the smoothing coefficient CXREF by retrieval from the table whose characteristic is similar to that shown in FIG. 13. The program then proceeds to S326 in which the post-engine-start idling learning control value AXREF is similarly calculated. When the shift lever 32 is found to be shifted to Forward (or Reverse) in S314, the processing operations of S328 to S336 are carried out to calculate the smoothing coefficient CXREF by retrieval from the table whose characteristic is similar to that shown in FIG. 13.

The program then proceeds to S338 in which the post-engine-start trolling learning control value TXREF is similarly calculated. The learning control values AXREF and TXREF calculated in the foregoing manner are stored in the EEPROM 22*a*, where they are retained even after the engine 16 has been stopped.

The explanation of the flow chart of FIG. 11 will be continued. Next, in S222, the calculated learning control value is subjected to a limit check.

Figure 14:
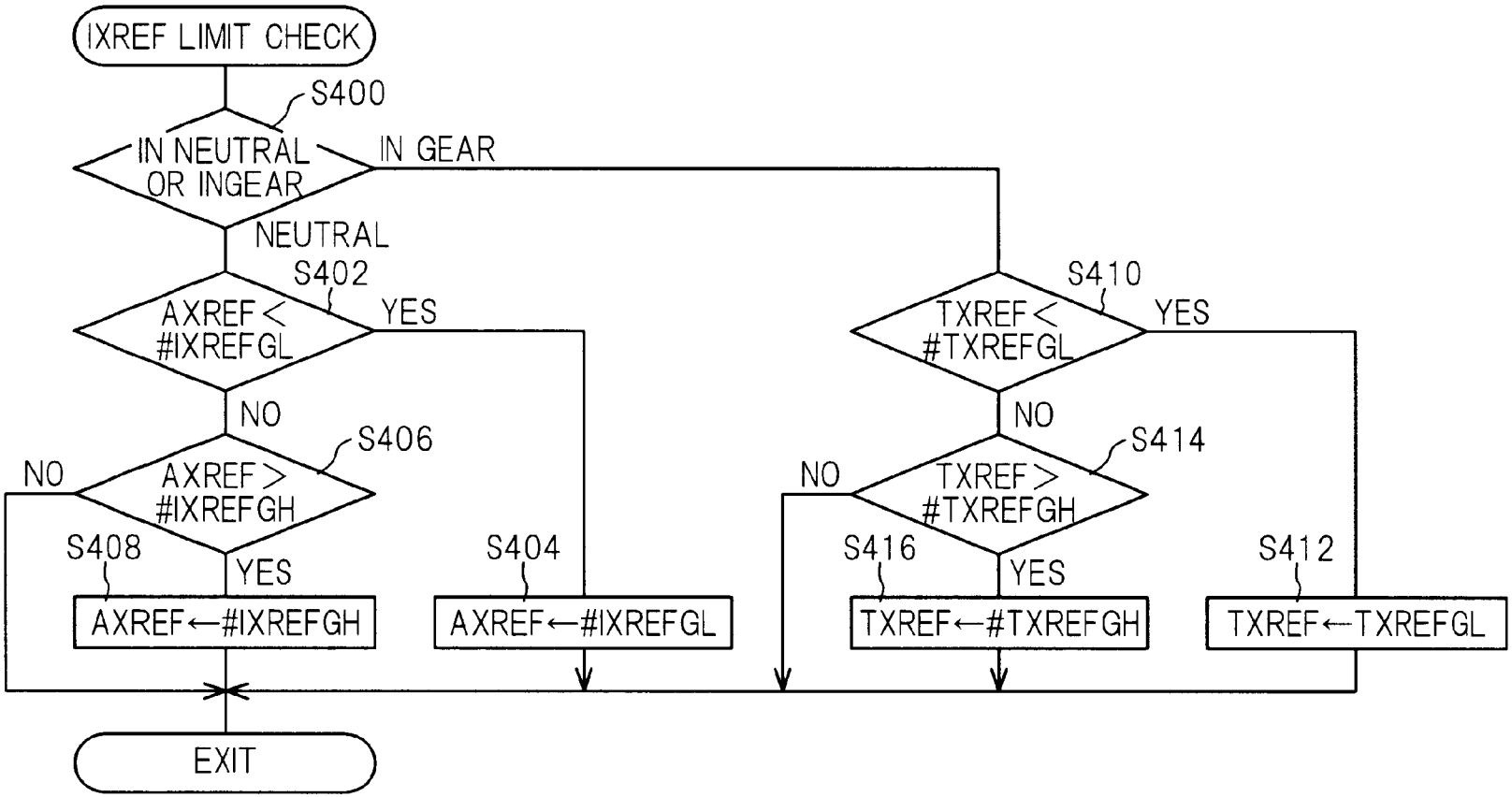
FIG. 14 is a subroutine flow chart showing the sequence of operations for limit-check processing of the learning control value IXREF in the subroutine flow chart of FIG. 11.

FIG. 14 is a subroutine flow chart showing the sequence of operations for this purpose.

In S400, it is checked whether the shift lever 32 is in Neutral or in Forward (or Reverse). When it found to be in Neutral, the program proceeds to S402 in which it is checked whether the calculated idling learning control value AXREF is less than a predetermined lower limit value #IXREFGL. When the result is YES, the program proceeds to S404 in which the lower limit value #IXREFGH is defined as the learning control value.

When the result in S402 is NO, the program proceeds to S406 in which it is checked whether the calculated idling learning control value AXREF is greater than an upper limit value #IXREFGH. When the result is YES, the program proceeds to S408 in which the upper limit value #IXREFGH is defined as the learning control value. When the result is NO, S408 is skipped.

When the result in S400 is the IN GEAR state, i.e., when it is found that the shift lever 32 is shifted to Forward (or Reverse), the program proceeds to S410 in which it is checked whether the calculated trolling learning control value TXREF is less than a lower limit value #TXREFGL. When the result is YES, the program proceeds to S412 in which the lower limit value #TXREFGL is defined as the learning control value.

When the result in S410 is NO, the program proceeds to S414 in which it is checked whether the calculated trolling learning control value TXREF is greater than an upper limit value #TXREFGH. When the result is YES, the program proceeds to S416 in which the upper limit value #TXREFGH is defined as the learning control value. When the result in S414 is NO, S416 is skipped.

The calculation of the desired idling speed NOBJ will now be explained.

Figure 15:
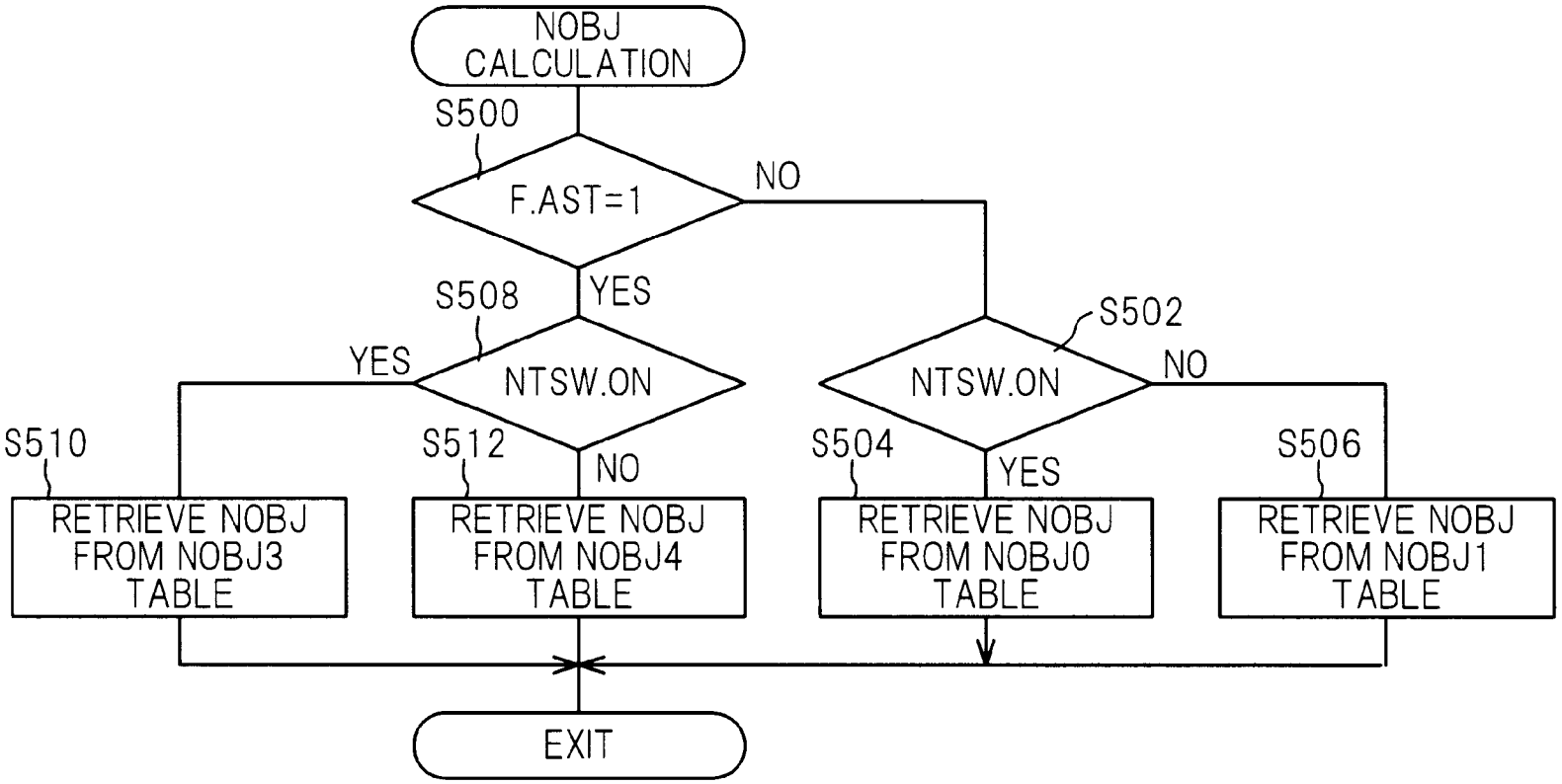
FIG. 15 is a flow chart showing the sequence of operations for calculating a desired idling speed during operation of the idling speed control system for the engine of the motor shown in FIG. 1.

FIG. 15 is a subroutine flow chart showing the sequence of operations for this calculation.

In S500, it is checked whether the bit of the flag F.AST is set to 1. When the result is NO, meaning that the engine is in start mode, the program proceeds to S502 in which it is checked whether the neutral switch 34 is outputting an ON signal, i.e., whether the shift lever 32 is shifted to Neutral. When the result in S502 is YES and the shift lever 32 is found to be shifted to Neutral, the program proceeds to S504 in which the desired idling speed NOBJ is calculated by retrieval from a table (characteristic) representing NOBJ0 in FIG. 16 using the detected engine coolant temperature TW and engine speed NE as address data.

Figure 16:
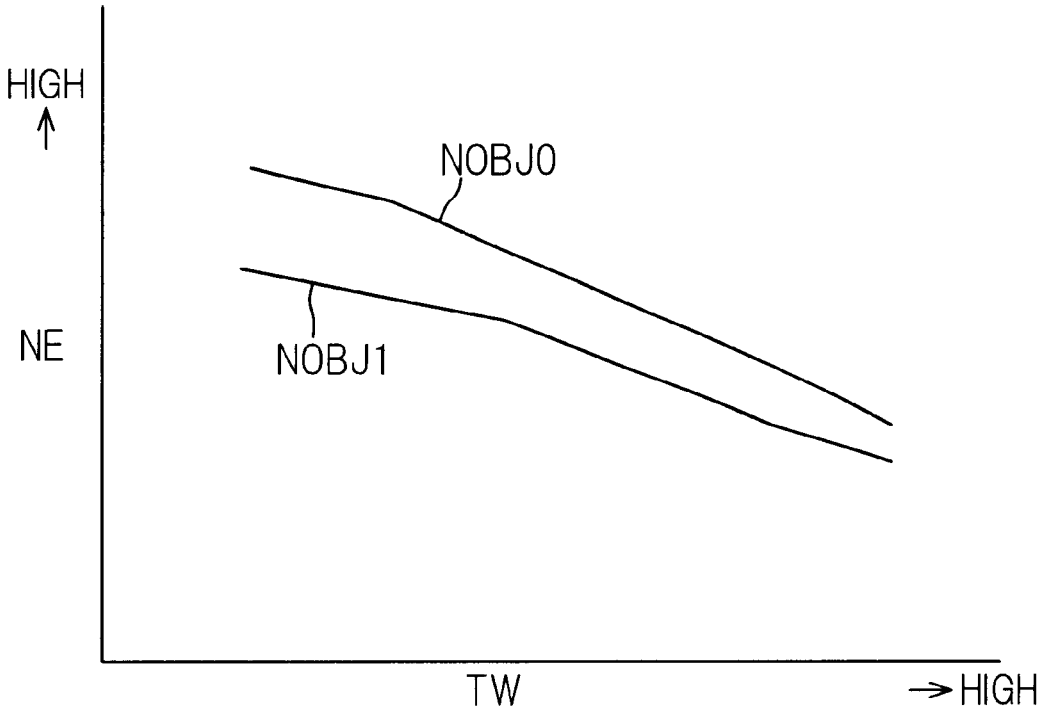
FIG. 16 is a graph for explaining a characteristic of the desired idling speed calculated in the flow chart of FIG. 15.
Figure 17:
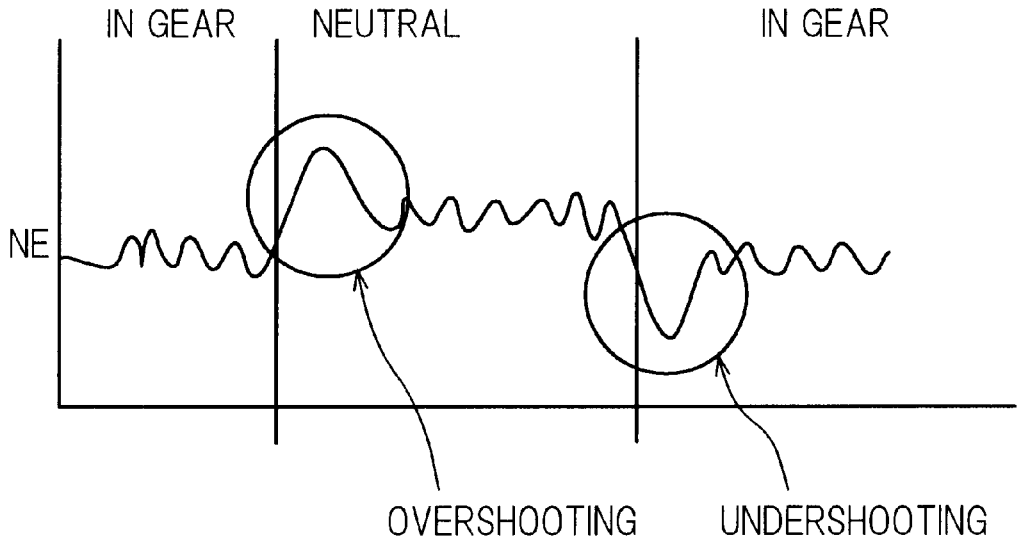
FIG. 17 is a time chart explaining a problem in the prior art idling speed control system for an outboard motor.

When the result in S502 is NO and the shift lever 32 is found to be shifted to Forward (or Reverse), the program proceeds to S506 in which the desired idling speed NOBJ is calculated by retrieval from a table (characteristic) representing NOBJ1 in FIG. 16 using the detected engine coolant temperature TW and engine speed NE as address data.

When the result in S500 is YES, meaning that the engine is in start mode, the program proceeds to S508 in which it is checked whether the neutral switch 34 is outputting an ON signal. When the result is YES, the program proceeds to S510 in which the desired idling speed NOBJ is calculated by retrieval from a table (characteristic) NOBJ3 like the table representing NOBJ0 in FIG. 16 using the detected engine coolant temperature TW and engine speed NE as address data.

When the result in S508 is NO and the shift lever 32 is found to be shifted to Forward (or Reverse), the program proceeds to S512 in which the desired idling (trolling) speed NOBJ is calculated by retrieval from a table (characteristic) NOBJ4 like the table representing NOBJ1 in FIG. 16 using the detected engine coolant temperature TW and engine speed NE as address data.

Having been configured in the foregoing manner, in this embodiment, when the engine speed NE is likely to change abruptly, in other words, when the difference between the preceding and present current command values IFB is large, the current command value IFB is increased or decreased by the predetermined value DIFBHEX1, 2 such that the engine speed is changed to the desired speed gradually or stepwise. With this, it becomes possible to suppress the occurrence of the overshooting or undershooting of engine speed due to the load change and to eliminate or reduce the shock experienced by the operator of the outboard in such a way that he or she can have an improved feeling.

Further, if the operator should replace the propeller which results in the load change, since the predetermined value #DIFB is set to be increased with increasing load, it becomes possible to take the change of the amount of secondary air due to the fluctuation of load into account and to make the transient time from the idling speed to the trolling speed (and vice versa) constant. This can improve the feeling experienced by the operator.

Further, the values #DIFBHEX1 for subtraction and #DIFBHEX2 for addition are predetermined relative to the engine coolant temperature TW. To be more specific, since the control response improves as the temperature increases, the values are set to be finer or smaller with increasing temperature. With this, it becomes possible to conduct finer control until the engine speed reaches the desired speed at a high engine coolant temperature. Accordingly, it becomes possible to switch the engine speed from the idling to trolling (and vice versa) in a smoother manner and to give a better feeling to the operator.

Further, since the value DIFBHEX1 for subtraction is set to be larger than the value DIFBHEX2 for addition, it becomes possible to bring the engine speed to the trolling speed promptly when the clutch is shifted to the trolling position (Forward or Reverse), and to achieve a finer and smoother transitional speed to the idling speed when the clutch is shifted back to Neutral. With this, it becomes to further improve the feeling experienced by the operator. When the clutch is returned to Neutral, since more time is permitted than the case where the clutch is shifted in the trolling direction, no problem will occur when stages to return to the idling speed is made finer, i.e., when a time to return to the idling speed is prolonged.

Further, the desired idling (or trolling) speed NOBJ is changed according to the shift (clutch) position in the start-state of the engine 16 and as shown in FIG. 9(*d*). As a result, the desired idling (or trolling) speed can be reliably determined in accordance with the engine operating condition and the shift position.

Furthermore, since the system controls the amount of secondary air (required air amount) so as to achieve the determined desired (trolling) idling speed, accurate control can be effected to achieve steady idling (trolling) speed. In addition, since the system can achieve a lower engine speed than the conventional system during trolling and the like, it is capable of enhancing fuel performance.

The embodiment is thus configured to have a system for controlling an idling speed for an outboard motor mounted on a boat 12 and equipped with an internal combustion engine 16 whose output is connected to a propeller 40 through a clutch 36 such that the boat is propelled forward or reverse when the clutch is changed to a neutral (Neutral) position to a forward (Forward) position or a reverse (Reverse) position, comprising a secondary air supplier 80 that supplies secondary air trough a passage (branch passage 72) that is connected to an air intake pipe 46 downstream of a throttle valve 50 and that is equipped with a secondary air control valve (EACV 74) such that amount of secondary air is supplied to the air intake pipe in response to an opening of the secondary air control valve; clutch position detecting means (neutral switch (NTSW) 34, ECU 22, S118, S162) for detecting a position of the clutch; engine operating condition detecting means (crank angle sensor 124, manifold absolute pressure sensor 94, intake air temperature sensor 100, coolant temperature sensor 106, ECU 22) for detecting parameters indicative of operating conditions of the engine including at least an engine speed NE; desired value determining means (ECU 22) for determining a desired idling speed based on the detected position of the clutch and for determining a desired secondary air supply amount (i.e., current command value IFB indicative of the amount of secondary air) such that a difference between the determined desired idling speed and the detected engine speed decreases; and valve controlling means (ECU 22) for controlling the opening of the valve to a value that effects the desired secondary air supply amount; wherein the desired value determining means including: comparing means (ECU 22, S162, S166) for calculating a change of the desired secondary air supply amount and for comparing the change with a predetermined value #difb when it is determined based on the detected position of the clutch that the clutch is changed; change direction determining means (ECU 22, S168) for determining whether the change is in an increasing direction or in a decreasing direction; and correcting means (ECU 22, S170, S172) for correcting the desired secondary air supply amount by a predetermined correction amount DIFBHEX 1,2 in the determined direction, when the change is greater than the predetermined value.

In the system, the predetermined value is set with respect to a load exerted on the engine. More specifically, the predetermined value is set to be increased with increasing load.

In the system, the predetermined correction amount is set with respect to a coolant temperature TW of the engine. More specifically, the predetermined correction amount is set to be decreased with increasing temperature.

In the system, the predetermined correction amount DIFBHEX 1, 2 is set to be different for different directions, and the predetermined correction amount in the decreasing direction is set to be greater than that in the increasing direction.

In the system, the comparing means calculates a change of the desired secondary air supply amount in an absolute value between the amount of a preceding control cycle and that of a present cycle.

In the system, the desired value determining means learning-controls the determined desired secondary air supply amount (ECU 22, S300 to S338).

In the system, the desired value determining means learning-controls the determined desired secondary air supply amount such that the difference between the desired idling speed and the detected engine speed decreases (ECU 22, S300 to S338).

In the system, the desired value determining means determines the desired secondary air supply amount in terms of current command value IFB to operate the secondary air control valve (EACV 74).

It should be noted that, although the invention has been explained with reference to an embodiment of an outboard motor, the invention is not limited in application to an outboard motor but can also be applied to an inboard motor.

It should also be noted that, although the invention has been explained with reference to an embodiment equipped not only with a secondary air supplier but also with a DBW (Drive-by-Wire) system for driving the throttle valve with an actuator, the DBW system is not an essential feature of the invention.

The entire disclosure of Japanese Patent Application No. 2000-400349 filed on Dec. 28, 2000, including specification, claims, drawings and summary, is incorporated herein in reference in its entirety.

While the invention has thus been shown and described with reference to specific embodiments, it should be noted that the invention is in no way limited to the details of the described arrangements but changes and modifications may be made without departing from the scope of the appended claims.

What is claimed is:

1. A system for controlling an idling speed for an outboard motor mounted on a boat and equipped with an internal combustion engine whose output is connected to a propeller through a clutch such that the boat is propelled forward or reverse when the clutch is changed to a neutral position to a forward position or a reverse position, comprising:

a secondary air supplier that supplies secondary air through a passage that is connected to an air intake pipe downstream of a throttle valve and that is equipped with a secondary air control valve such that an amount of secondary air is supplied to the air intake pipe in response to an opening of the secondary air control valve;

clutch position detecting means for detecting whether or not the clutch is at a neutral position;

engine operating condition detecting means for detecting parameters indicative of operating conditions of the engine including at least an engine speed;

desired value determining means for determining a desired idling speed based on whether or not the detected position of the clutch is at the neutral position and for determining a desired secondary air supply amount such that a difference between the determined desired idling speed and the detected engine speed decreases; and valve controlling means for controlling the opening of the valve to a value that effects the desired secondary air supply amount;

wherein the desired value determining means includes:

comparing means for calculating a change of the desired secondary air supply amount and for comparing the change with a predetermined value when it is determined based on the detected position of the clutch that the clutch is changed;

change direction determining means for determining whether the change of the desired secondary air supply amount is in an increasing direction or in a decreasing direction; and correcting means for correcting the desired secondary air supply amount by a predetermined correction amount in the determined direction, when the change is greater than the predetermined value.

2. A system according to claim 1, wherein the predetermined value is set with respect to a load exerted on the engine.

3. A system according to claim 2, wherein the predetermined value is set to be increased with increasing load.

4. A system according to claim 1, wherein the predetermined correction amount is set with respect to a coolant temperature of the engine.

5. A system according to claim 4, wherein the predetermined correction amount is set to be decreased with increasing temperature.

6. A system according to claim 5, wherein the predetermined correction amount is set to be different for different directions.

7. A system according to claim 6, wherein the predetermined correction amount in the decreasing direction is set to be greater than that in the increasing direction.

8. A system according to claim 1, wherein the comparing means calculates a change of the desired secondary air supply amount in an absolute value between the amount of a preceding control cycle and that of a present cycle.

9. A system according to claim 1, wherein the desired value determining means learning-controls the determined desired secondary air supply amount.

10. A system according to claim 9, wherein the desired value determining means learning-controls the determined desired secondary air supply amount such that the difference between the desired idling speed and the detected engine speed decreases.

11. A system according to claim 1, wherein the desired value determining means determines the desired secondary air supply amount in terms of current command value to operate the secondary air control valve.

12. A method of controlling an idling speed for an outboard motor mounted on a boat and equipped with an internal combustion engine whose output is connected to a propeller through a clutch such that the boat is propelled forward or reverse when the clutch is changed to a neutral position to a forward position or a reverse position, having a secondary air supplier that supplies secondary air through a passage that is connected to an air intake pipe downstream of a throttle valve and that is equipped with a secondary air control valve such that amount of secondary air is supplied to the air intake pipe in response to an opening of the secondary air control valve, comprising the steps of (a) detecting whether or not the clutch is at a neutral position;

(b) detecting parameters indicative of operating conditions of the engine including at least an engine speed;

(c) determining a desired idling speed based on whether or not the detected position of the clutch is the neutral position and for determining a desired secondary air supply amount such that a difference between the determined desired idling speed and the detected engine speed decreases; and (d) controlling the opening of the valve to a value that effects the desired secondary air supply amount; wherein the step (c) including the steps of:

(e) calculating a change of the desired secondary air supply amount and comparing the change with a predetermined value when it is determined based on the detected position of the clutch that the clutch is changed;

(f) determining whether the change of the desired secondary air supply amount is in an increasing direction or in a decreasing direction; and (g) correcting the desired secondary air supply amount by a predetermined correction amount in the determined direction, when the change is greater than the predetermined value.

13. A method according to claim 12, wherein the predetermined value is set with respect to a load exerted on the engine.

14. A method according to claim 13, wherein the predetermined value is set to be increased with increasing load.

15. A method according to claim 12, wherein the predetermined correction amount is set with respect to a coolant temperature of the engine.

16. A method according to claim 15, wherein the predetermined correction amount is set to be decreased with increasing temperature.

17. A method according to claim 16, wherein the predetermined correction amount is set to be different for different directions.

18. A method according to claim 17, wherein the predetermined correction amount in the decreasing direction is set to be greater than that in the increasing direction.

19. A method according to claim 12, wherein the step (e) calculates a change of the desired secondary air supply amount in an absolute value between the amount of a preceding control cycle and that of a present cycle.

20. A method according to claim 12, wherein the step (c) learning-controls the determined desired secondary air supply amount.

21. A method according to claim 20, wherein the step (c) learning-controls the determined desired secondary air supply amount such that the difference between the desired idling speed and the detected engine speed decreases.

22. A method according to claim 12, wherein the step (c) determines the desired secondary air supply amount in terms of current command value to operate the secondary air control valve.

* * * * *